US007553069B2

(12) United States Patent
Gibbons

(10) Patent No.: US 7,553,069 B2
(45) Date of Patent: Jun. 30, 2009

(54) SYSTEMS AND METHODS FOR PROVIDING A WRISTWATCH

(76) Inventor: Roger C. Gibbons, Box 55, Mattapoisett, MA (US) 02739

( * ) Notice: Subject to any disclaimer, the term of this patent is extended or adjusted under 35 U.S.C. 154(b) by 0 days.

(21) Appl. No.: 11/425,085

(22) Filed: Jun. 19, 2006

(65) Prior Publication Data

US 2007/0097688 A1 May 3, 2007

Related U.S. Application Data

(60) Provisional application No. 60/731,510, filed on Oct. 31, 2005.

(51) Int. Cl.
*A44C 5/00* (2006.01)

(52) U.S. Cl. ..... 368/282; 368/276; 224/219

(58) Field of Classification Search ..... 224/164, 224/218–219, 165–179; 368/282, 276, 281
See application file for complete search history.

(56) References Cited

U.S. PATENT DOCUMENTS

| | | | | | |
|---|---|---|---|---|---|
| 2,189,096 | A * | 2/1940 | Vera | 224/170 |
| 2,249,550 | A * | 7/1941 | Williams | 368/281 |
| 2,513,892 | A * | 7/1950 | Pile | 224/179 |
| 2,649,230 | A * | 8/1953 | Thompson | 368/286 |
| 3,492,809 | A * | 2/1970 | Gisiger-Lusa | 368/282 |
| 4,060,185 | A * | 11/1977 | Kuroda | 224/176 |
| 4,159,792 | A * | 7/1979 | Siegal | 224/267 |
| 4,167,850 | A * | 9/1979 | Schneider | 368/282 |
| 4,239,136 | A * | 12/1980 | Godwin | 224/219 |
| 4,277,842 | A * | 7/1981 | Richards | 368/282 |
| 4,794,577 | A * | 12/1988 | Meyrat | 368/282 |
| 4,855,974 | A | 8/1989 | Steinmann | |
| 4,862,521 | A * | 9/1989 | Mann | 2/160 |
| 4,916,679 | A * | 4/1990 | Agnello | 368/283 |
| 4,958,279 | A * | 9/1990 | Proellochs | 368/282 |
| 5,154,506 | A * | 10/1992 | Leard | 362/103 |
| 5,610,877 | A | 3/1997 | Adams et al. | |
| 5,639,000 | A * | 6/1997 | McDaniel et al. | 224/175 |
| 5,762,241 | A * | 6/1998 | Cross | 224/173 |
| 5,838,642 | A * | 11/1998 | Tully | 368/282 |
| 6,108,876 | A * | 8/2000 | Hubbert | 24/265 WS |
| 6,199,730 | B1 * | 3/2001 | Chisolm | 224/164 |
| 6,213,634 | B1 | 4/2001 | Harrington et al. | |
| 6,227,424 | B1 * | 5/2001 | Roegner | 224/219 |
| 6,234,668 | B1 * | 5/2001 | Cooper | 368/281 |
| D454,078 | S | 3/2002 | Koo | |
| D459,664 | S | 7/2002 | Koo | |
| 6,799,887 | B1 * | 10/2004 | Kinney | 368/282 |
| 6,857,775 | B1 | 2/2005 | Wilson | |
| D514,975 | S * | 2/2006 | Blackmore | D10/131 |
| 7,124,447 | B2 * | 10/2006 | Arganese | 2/160 |

* cited by examiner

*Primary Examiner*—Renee S Luebke
*Assistant Examiner*—Sean Kayes
(74) *Attorney, Agent, or Firm*—Jim Ruttler

(57) ABSTRACT

This invention relates generally to watches, and more specifically, to systems and methods for providing a wristwatch. In one embodiment, the invention includes a wristband including a strap, the strap being formed from an elastic textile, wherein the strap defines an orifice, the orifice configurable to being removably coupled to a housing member by elastically retracting around the housing member. In a further embodiment, the housing member further includes any of a timepiece, a computer, a music player, and a decorative element. In yet a further embodiment, the strap defines a continuous loop. In an additional embodiment, the housing member further includes Velcro® to further couple the housing member to the strap.

12 Claims, 5 Drawing Sheets

SYSTEMS AND METHODS FOR PROVIDING A WRISTWATCH

PRIORITY CLAIM

This application claims priority to U.S. Provisional Application 60/731,510 filed Oct. 31, 2005. This application refers to Disclosure Document 561,870 filed Oct. 4, 2004. The foregoing application and disclosure document are hereby incorporated by reference in their entirety as if fully set forth herein.

FIELD OF THE INVENTION

This invention relates generally to wristbands, and more specifically, to systems and methods for providing a wristwatch.

BACKGROUND OF THE INVENTION

Since early civilization realized the need to track the time of day, people have searched for new ways of telling time. Early known sun clocks made by the Egyptians were enormous obelisks that allowed users track the time of day by shadow. Other natural clocks such as water or sand timers emerged thereafter, but telling time was revolutionized when mechanical clocks were first invented, which was likely some time in the early 14th century. The clock or watch saw many embodiments, some large, and some small, but it was not until 1868 that Patek Philippe is credited with creating the first wristwatch. In the following years, the wristwatch quickly became a pervasive means of telling time.

Modern wristwatches can be of many types, including digital, mechanical, or atomic clocks. Additionally, many designs exist for different types of watch bands, each of which offer different functionalities. The most well known styles consist of two straps pin-connected to opposite sides of a timepiece, which extend around the wearer's wrist and connect with a buckle. These bands consist of materials ranging from rubber, to leather, to plastic, to metal, which particularly suffers from pinching skin or hair. Various other types of attachment from the band to the timepiece exist. Some include straps that slide through buckles integrated in the timepiece holder, allowing the timepiece to slide back and forth along the watch band. Some bands include a cover under which the timepiece sits, in order to provide protection for the timepiece. Still others are one-piece watches where the timepiece is physically integrated with the band, forming a permanent attachment.

Although these types of watch bands can be attractive and ornamental, they can be cumbersome to use because many wristwatch straps must be disengaged and reengaged to be placed on or removed from a user's wrist. Taking a watch on and off can be time consuming and cumbersome, especially when it needs to be done frequently or quickly. Additionally, many watches suffer from limitations regarding size. Many watch bands have only one size, and therefore can only be worn by one user on one part of the body. Moreover, even watches that can be configured for different sizes cannot be done so easily and must be manipulated before size change can be accomplished. Therefore, users of current wristwatches cannot quickly put the watch on or off their wrists, cannot slide the watch up their arms quickly, and cannot easily carry the watch on multiple parts of their body or share it with users who are of different sizes.

Additionally, most wristwatches do not facilitate manipulation or removal of the timepiece. Many users of wristwatches enjoy wearing a wristwatch so that the timepiece is on the outside of their wrist, but then sometimes on the inner side of their wrist. Most wristwatches are configured so that the timepiece can be viewed most easily when on the top of the wrist, which is a configuration where 12:00 is perpendicular to the bones of the arm. When a watch is worn on the inside of the wrist, however, this configuration of the timepiece is not the most ergonomically pleasant configuration to view the timepiece; instead, a configuration where 12:00 is parallel to the bones of the arm is best. Unfortunately most watches are unable to rotate within the watch strap and cannot be ideally configured. Therefore, what is needed are systems and methods for providing a wristwatch.

SUMMARY OF THE INVENTION

This invention relates generally to watches, and more specifically, to systems and methods for providing a wristwatch. In one embodiment, the invention includes a wristband including a strap, the strap being formed from an elastic textile, wherein the strap defines an orifice, the orifice configurable to being removably coupled to a housing member by elastically retracting around the housing member. In a further embodiment, the housing member further includes any of a timepiece, a computer, a music player, and a decorative element. In yet a further embodiment, the strap defines a continuous loop. In an additional embodiment, the housing member further includes Velcro® to further couple the housing member to the strap.

BRIEF DESCRIPTION OF THE DRAWINGS

Embodiments of the present invention are described in detail below with reference to the following drawings.

DETAILED DESCRIPTION

This invention relates generally to wristbands, and more specifically, to systems and methods for providing a wristwatch. Specific details of certain embodiments of the invention are set forth in the following description and in FIGS. 1-10 to provide a thorough understanding of such embodiments. The present invention may have additional embodiments, or may be practiced without one or more of the details described for any particular described embodiment.

Figure 1:
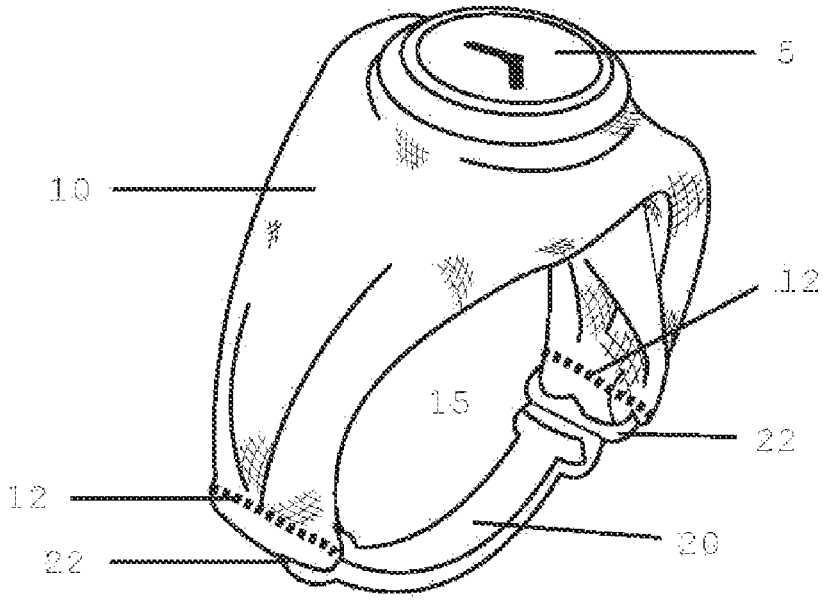
FIG. 1 is a perspective view of a wristwatch, in accordance with an embodiment of the invention.

FIG. 1 is a perspective view of a wristwatch, in accordance with an embodiment of the invention. FIG. 1 shows a watch 5, held within a strap 10. In one embodiment, the watch 5 is removable to permit alternative watches to be inserted therein or to permit alternative devices to be inserted therein. Alternative components will be discussed through the application, but may include mp3 players, compasses, or mere decoration. In other embodiments, the watch 5 is removably held on the surface of the strap 10 by way of Velcro®, pins, pass through slots or other methodology. In one embodiment, the strap 10 is attached to an extension member 20 at a coupling point 22 of the extension member 20 and strap 10. In one particular embodiment, the strap 10 is extensible. Indeed, in certain embodiments, any strap is extensible in any one of the embodiments disclosed herein. The first coupling point 22 is formed from a first section of the strap 10 passing through a first loop in the extension member 20 and the first section of the strap 10 is attached to itself, forming a loop in the strap 10, which is closed and coupled by stitching 12. The second coupling point 22 is further formed from a second section of the strap 10 passing through a second loop in the extension member 20 and the second section of the strap 10 is attached to itself, forming a loop in the strap 10, which is closed and coupled by stitching 12. The resulting structure is a closed loop 15 comprising the strap 10 and extension member 20.

In one embodiment, the strap 10 can comprise any type of material such as natural textile, synthetic textile, hybrid textile, leather, plastic, rubber or paper. In another embodiment, the strap 10 may be one or more colors or texture. In a further embodiment the strap 10 can be any type of textile with elastic properties such as spandex, elastane, Lycra®, Elaspan®, Dorlastan®, Linel®, Tactel®, Milliskin® or any other textile comprising one or more elastic textile or any other textile comprising one or more elastic textile and one or more non-elastic or semi-elastic textile such as alpaca, cashmere, silk, wool, cotton, rayon, modal, acrylic, nylon, polyester, or polypropylene. In a still further embodiment, the strap 10 can be produced by any production method, including, but not limited to braiding, plaiting, crochet, felt, knitting, knotting, macramé, lace, pile, or weaving. In another embodiment the strap 10 is a textile comprising nylon and spandex.

In one embodiment, the extension member 20 can comprise any material having any property such as textile, leather, plastic, rubber, metal, glass, or ceramic and can be in any shape. In a further embodiment, the coupling point 22 of the extension member 20 and the strap 10 can be of any type and by any means of coupling or joining, including, but not limited to a buckle, glue, welding, Velcro®, slot and pin, screw, knotting, clasp, magnet or hinge. In a further embodiment, the extension member 20 includes a timepiece. In another embodiment, the extension member 20 is omitted and the strap 10 is either a continuous loop or configurable to being coupled to define a continuous loop.

In this regard, a wristband is established that is expandable without the need for adjusting buckles and that permits removably inserting various components such as a watch, music player, or compass.

Figure 2:
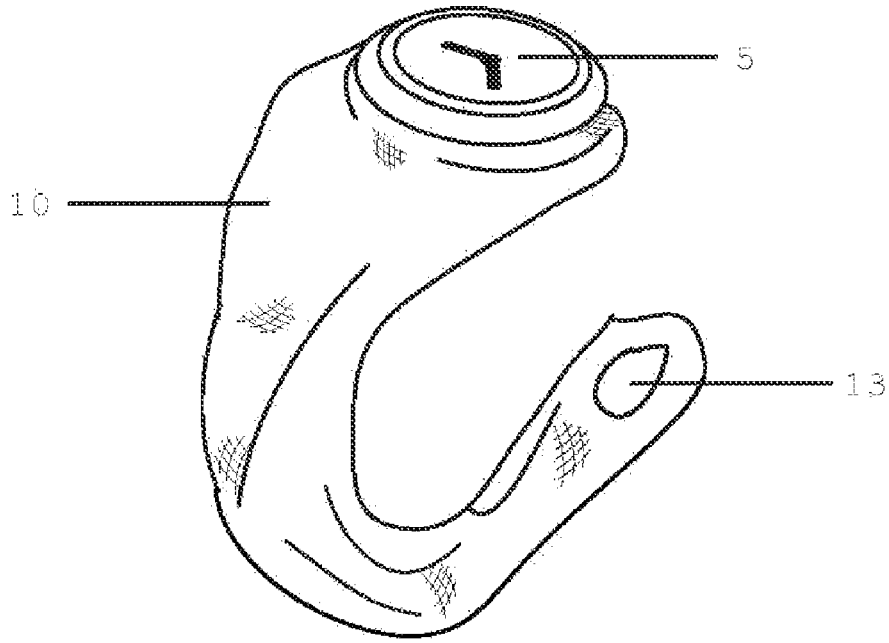
FIG. 2 is a perspective view of a wristwatch, in accordance with a further embodiment of the invention.

FIG. 2 is a perspective view of a wristwatch, in accordance with a further embodiment of the invention. FIG. 2 depicts a watch 5, which is held in or on a strap 10 on a first end of the strap 10. As discussed with reference to FIG. 1, the watch 5 may be held within the strap 10 via a strap orifice or on the surface by pins, pass through slots, or even be part of the strap 10. In certain embodiments, the watch 5 may be removed and replaced with alternative components. Additionally, in one embodiment, there is strap orifice 13 on a second end of the strap 10. In one embodiment, the strap orifice 13 can be provided by any means of providing an orifice or hole, such as cutting, piercing, burning, punching, or the strap orifice can be provided during manufacture of the strap.

In one embodiment of the present invention, the strap orifice 13 is stretched and placed over the watch 5. The watch 5 is configured to be held within the strap orifice 13, which results in a closed loop comprising the strap 10 and the watch 5.

Figure 3:
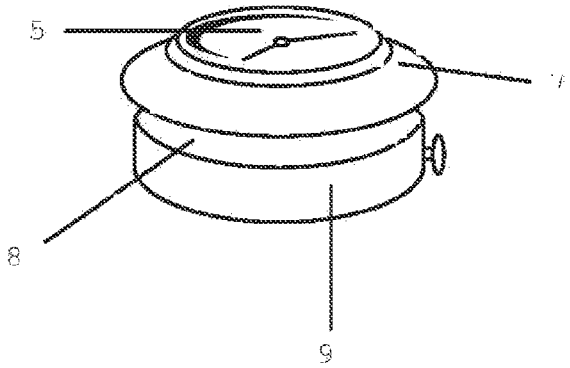
FIG. 3 is a perspective view of a watch housing, in accordance with an embodiment of the invention.

FIG. 3 is a perspective view of a watch and watch housing, in accordance with an embodiment of the invention. FIG. 3 depicts a watch 5 and watch housing, which comprises a first bulbous watch housing member 7, a second bulbous watch housing member 9 and a slot 8 between the first bulbous watch housing member 7 and the second bulbous watch housing member 9.

In one embodiment of the invention the watch can be any type of watch, including, but not limited to mechanical, electromechanical, quartz, quartz analog, digital, radio controlled or sundial. In a further embodiment of the invention, the watch 5 and watch housing, (including the first bulbous watch housing member 7, the second bulbous watch housing member 9 and the slot 8 between the first bulbous watch housing member 7 and the second bulbous watch housing member 9), as well as any other component or part of the watch 5 or watch housing can be in any shape and can be any material including, but not limited to textile, leather, plastic, rubber, metal, glass, or ceramic. In a still further embodiment, the first bulbous housing member 7 can be more or less bulbous compared to the second bulbous housing member 9, or the first bulbous housing member 7 and second bulbous housing member 9 can be of equal size whether more or less bulbous.

In another embodiment, the watch and/or watch housing may further comprise any other functional device such as a calculator, video game, video screen, MP3 player, global positioning system, cellular telephone, satellite telephone, radio or personal data assistant. In a still further embodiment, the watch is instead replaced with an ornamental member that can be of any shape, size, material, color or texture. Alternative shapes are possible for the watch 5.

In one embodiment, the watch 5 is removably insertable into the strap 10 as described in reference to FIGS. 1 and 2. Any described orifice in the strap 10 stretches and retracts to reside within the slot 8 to securely hold the watch 5. In one particular embodiment, Velcro® is present on the housing member to further secure the watch 5 to the strap 10. In yet further embodiments, the watch housing may contain slots, Velcro®, or pins to couple the watch 5 onto the strap 10.

Figure 4:
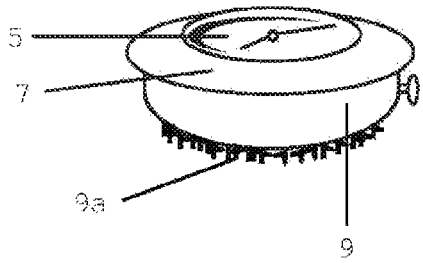
FIG. 4 is a perspective view of a watch housing, in accordance with a further embodiment of the invention.

FIG. 4 is a perspective view of a watch and watch housing, in accordance with a further embodiment of the invention. FIG. 4 depicts a watch 5 and watch housing, which comprises a first bulbous watch housing member 7, a second watch housing member 9 and hook Velcro® 9*a*, which is connected to the bottom of the second watch housing member 9. In certain embodiments, the watch 5 is configurable to being removably coupled to the strap 10, as described in FIGS. 1 and 2, using the Velcro®. Alternative embodiments for the watch 5 are possible, such as slots to permit the strap 10 to pass through or pins to attach to the strap 10. Alternatively, the watch may have a slot located more centrally to permit a band to pass through. Alternative shapes are possible for the watch 5. Furthermore, in certain embodiments, the watch 5 is replaceable with any other component such as a music player, compass, or decorative device.

Figure 5:
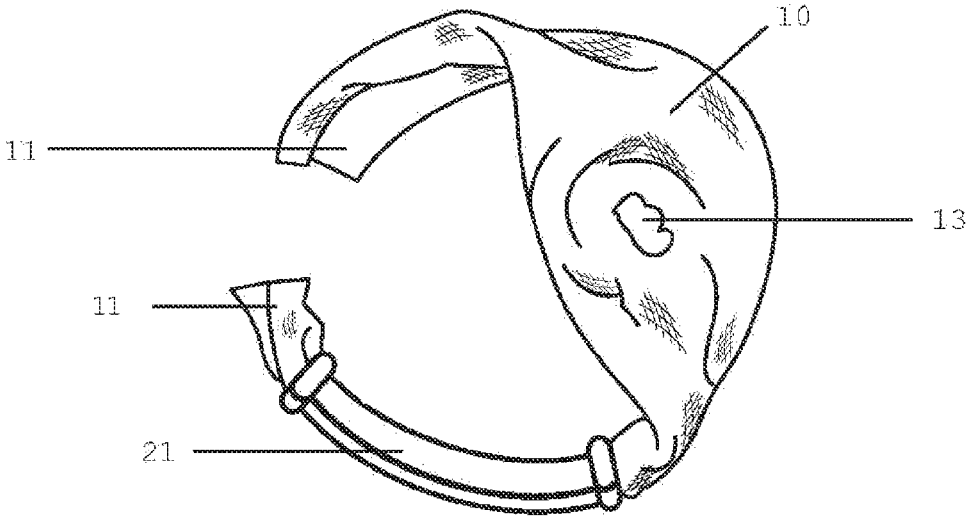
FIG. 5 is an elevational view of a wristwatch strap, in accordance with an embodiment of the invention.

FIG. 5 is an elevational view of a wristwatch strap, in accordance with an embodiment of the invention. FIG. 5 depicts a strap 10, the strap 10 comprising a strap orifice 13, and a first strap end 11 and a second strap end 11. Additionally, one end of the strap is enclosed by a tube 21.

Figure 6:
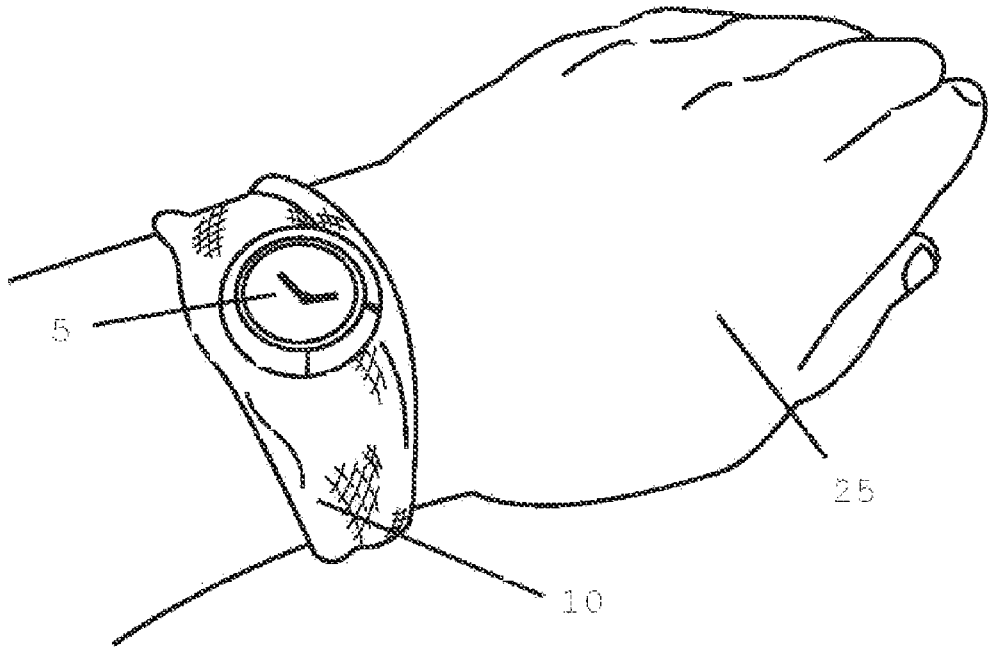
FIG. 6 is an environmental view of a wristwatch, in accordance with an embodiment of the invention being used in accordance with an embodiment of the invention.

In one embodiment of the invention, the first strap end 11 and the second strap end 11 can be connected in any way by any means of coupling or joining, including, but not limited to a buckles, glue, welding, Velcro®, slot and pin, screw, knotting, clasp, magnet, stitch or hinge, or may simply be a single piece. In a further embodiment of the invention, the tube can be configured or positioned to cover and/or conceal where the first strap end 11 and the second strap end 11 are joined. In one particular embodiment, the tube is made from rubber or plastic to aid in preventing slippage. In a further embodiment, the tube is not present or is replaced with an extension member as set forth in FIG. 1. In yet a further embodiment, the strap 10 is configurable to have curled edges as depicted in FIGS. 5 and 6.

In another embodiment of the invention, a watch or other component is configured to reside in the strap orifice 13. For example, the watch 5 and watch housing as depicted in FIG. 3 can be configured to reside in the strap orifice 13, as illustrated in FIG. 1. To achieve such a configuration, the strap orifice 13 is stretched over either the first bulbous watch housing member 7 or the second bulbous watch housing member 9 and the section of strap creating the strap orifice is allowed to retract and reside in the slot 8 between the first bulbous watch housing member 7 and the second bulbous watch housing member 9 (FIG. 3). In a still further embodiment the watch 5 can be freely rotated while held within the strap orifice 13.

In a further embodiment, the strap 10 can be in the form of a tube, which may be formed by a first longitudinal edge of the strap being attached or joined to a second longitudinal edge of the strap. This can be done my any method of joining or coupling as described herein or known in the art or using a tubular material from scratch. In a further embodiment, the strap 10 can have a strap orifice 13, which can be configured to hold a watch. The strap orifice may be through only one side of the tube or extend through both sides of the tube. Thus, in certain embodiments, the watch 5 and watch housing depicted in FIG. 3 or 4 can be configured to reside in the strap orifice 13. To achieve such a configuration, the strap orifice is stretched around the second bulbous watch housing member 9 and released such that the tension of strap 10 material holds the watch and watch housing in place. Velcro® may be present on the watch housing to further secure the watch 5. Additionally, the hook Velcro® 9*a* can be configured to secure or join the watch 5 and watch housing to the inside or outside of the strap 10. The strap 10 material can inherently possess the ability to secure to, or couple with the hook Velcro® 9*a*, or the hook Velcro® 9*a* may be secured or joined to a piece of loop Velcro® that is attached to the interior or exterior of the looped strap. In another embodiment, the watch may be secured to the interior or exterior of the looped strap by any means known in the art or described herein.

In a further embodiment of the present invention, the watch 5 may be removed and subsequently replaced by or interchanged with one or more alternative watch, timepiece, or other device or ornament as described herein or known in the art, such as an mp3 player, a compass, a depth reader.

FIG. 6 is an environmental view of a wristwatch in accordance with an embodiment of the invention. FIG. 6 depicts a wristwatch, the wristwatch comprising a watch 5 held in a strap 10, which is being worn on the wrist of a user 25. In one embodiment, the user 25 can stretch the strap 10 to remove the wristwatch from the wrist by sliding it over the hand or stretch the strap 10 to slide the wristwatch onto the users hand and subsequently onto the wrist of the user 25. In a further embodiment of the invention, the wristwatch may be worn on any part of the body, including, but not limited to, the hand, arm, shoulder, neck, head, leg, ankle, hair, or foot.

In a still further embodiment, the strap 10 of the wristwatch may be of any size so as to accommodate the wristwatch being worn on any part of a body or by any person, man, woman, child, or animal. In another embodiment, the strap 10 has elastic properties, which allows a user to wear the wristwatch on multiple parts of the body or to slide the wristwatch from one part of the body to another, such as sliding the watch up an arm while doing dishes. For example, a user can wear the wristwatch on the wrist, but then slide or move the wristwatch up the user's arm, where it will remain secure.

Figure 7:
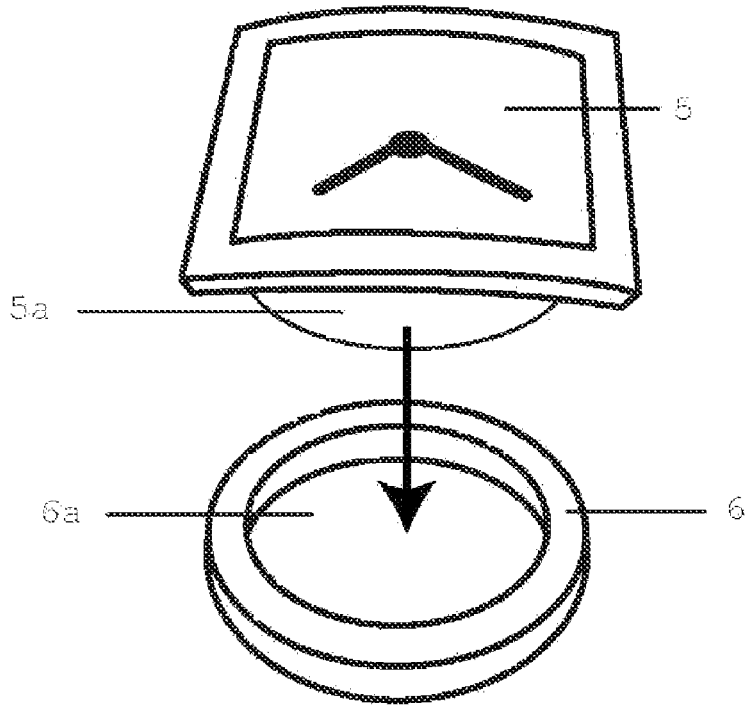
FIG. 7 is a perspective view of a watch housing and ring, in accordance with an embodiment of the invention.

FIG. 7 is a perspective view of a watch housing and watch housing coupling member, in accordance with an embodiment of the invention. In one embodiment, the watch 5, which is coupled to a ring plug 5*a*, is configurable to being removably inserted into a ring 6 through a ring orifice 6*a*. The ring plug 5*a* may be of any diameter, but is of smaller or equal diameter compared to the diameter of the ring orifice. In a further embodiment, the ring plug 5*a*, ring 6 and ring orifice 6*a* can be of any size or shape. In a still further embodiment the ring plug 5*a* may fully or partially complement the size and/or shape of the ring orifice 6*a*. In yet another embodiment, the ring plug 5*a*, ring 6, can be any material as described herein or known in the art. In certain embodiments, the ring 6 is configurable to being coupled to a wristband, either on, under, or within the wristband. The watch 5 is then configurable to being removably coupled to the ring on the wristband.

Figure 8:
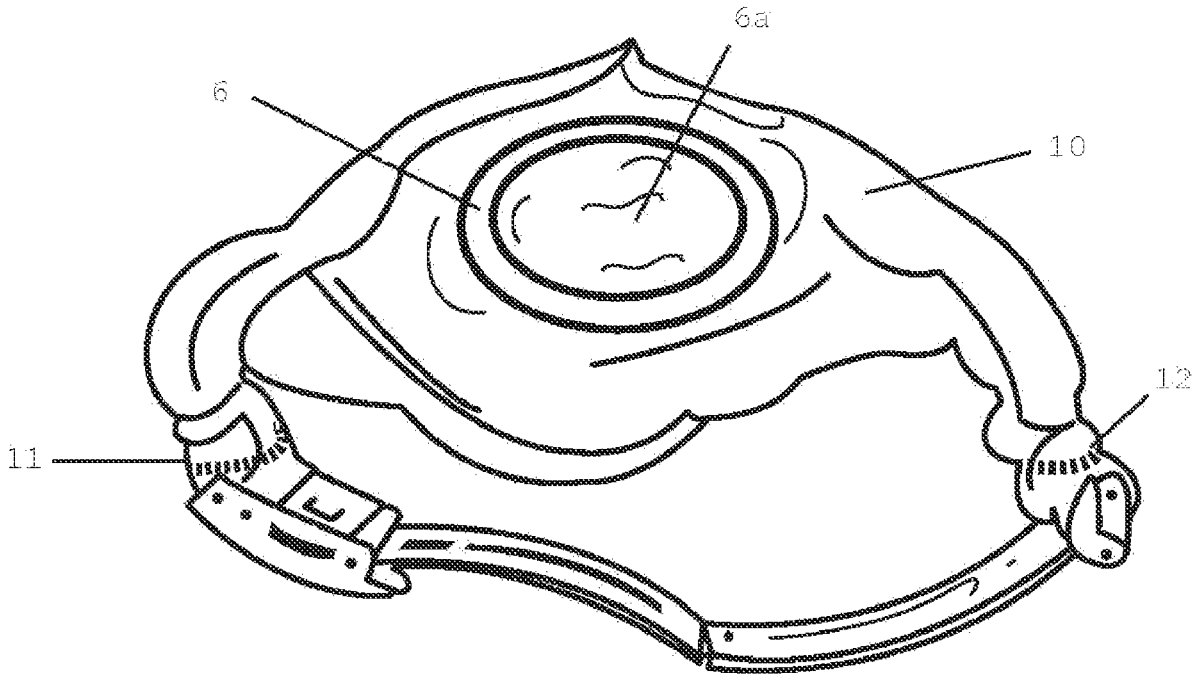
FIG. 8 is a perspective view of a wristwatch, in accordance with another embodiment of the invention.

FIG. 8 is a perspective view of a wristwatch, in accordance with another embodiment of the invention. FIG. 8 depicts the components described in FIG. 7 on a wristband. In this embodiment, the ring 6 is coupled to the under-side of the strap 10. The watch 5 with the ring plug 5*a* (not visible) is positioned on a first planar side of the strap 10 and the ring 6 is positioned on a second planar side of the strap 10. The ring plug 5*a* centered over the strap 10 and the ring orifice 6*a*. The ring plug 5*a* is depressed into the strap 10 and the ring orifice 6*a*. The friction between the ring plug 5*a*, the strap 10, and the ring 6 couples or secures the watch 5 to the strap 10. In a further embodiment, additional methods of disclosed herein or know in the art may be used to secure or couple the watch 5, the ring plug 5*a*, or the ring 6 to the strap 10. For instance, the ring plug 5*a* may be depressed directly into the ring 6, which may be itself secured to the strap 10.

Figure 9:
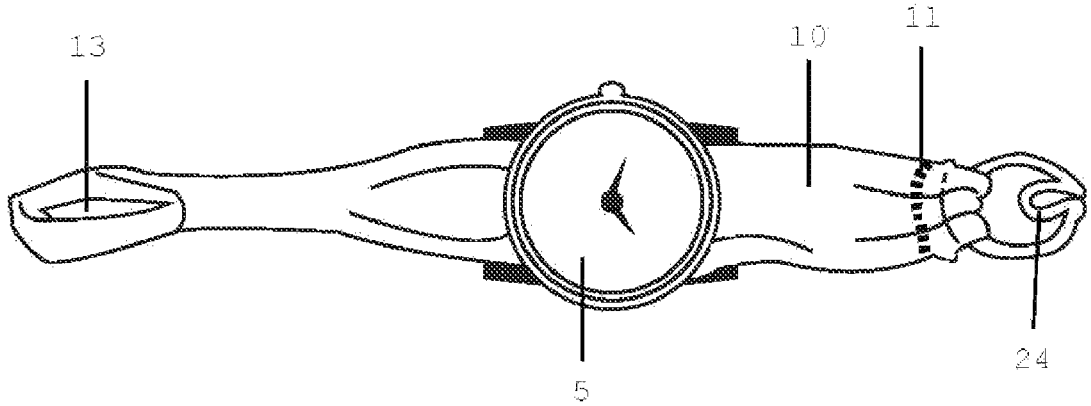
FIGS. 9 and 10 are top views of a wristwatch, in accordance with yet other embodiments of the invention.
Figure 10:
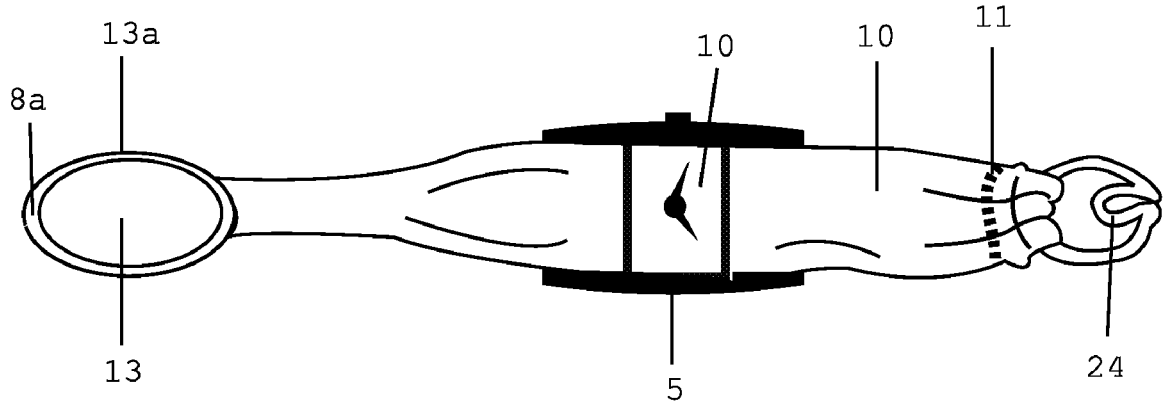

FIG. 9 is a perspective view of a wristwatch, in accordance with yet another embodiment of the invention. FIG. 9 depicts a watch 5 with two straps 10 attached to the watch. Alternatively, the watch 5 may have a single strap 10 that is passed through at least one slot in the watch 5 to secure the watch 5 to the strap 10. Alternatively, the watch 5 may be connected to a single strap 10 via Velcro® or pins. In another embodiment, the straps may be connected to the watch by any means described herein or by any means known in the art. In the embodiment illustrated, strap 10 includes a strap orifice 13 and a hook member 24, which may be removeably coupled to define a continuous loop. FIG. 10 is another embodiment substantially similar to that shown and described in FIG. 9.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined by reference to the claims that follow.

What is claimed is:

1. A wristband comprising:

(a) an elastic strap, the strap being formed from a highly elasticized smooth textile and having an orifice;

(b) a watch housing with a display portion and a cylindrical insert portion, the display portion and the cylindrical insert portion are separated by a slot; the cylindrical insert portion and the orifice of the strap are sized and configured such that the cylindrical insert portion can be inserted into the strap orifice such that deformation of the highly elasticized smooth textile of the orifice results in a retaining force that cooperates with the slot to retain the watch housing to the strap and;

(c) periphery of the insert portion does not extend beyond the periphery of the display portion.

2. The wristband of claim 1, wherein the strap is planar or hollow tubular.

3. The wristband of claim 1 wherein the housing member further includes any of a timepiece, a computer, a music player and a decorative element.

4. The wristband of claim 3 wherein the housing member further comprises hook and loop securing means, or slot and pin members to additionally couple the housing member to the strap.

5. The wristband of claim 1 further including a non-elastic extension member, wherein the strap is connected at each end of the non-elastic extension member to define a continuous loop.

6. The wristband of claim 5, wherein the extension member is a clasp.

7. The wristband of claim 1 further including a ring and a housing member, the ring being coupled to the strap, wherein the housing member is configurable to press into the ring.

8. The wristband of claim 1 wherein the housing member is configurable to freely rotate within the orifice.

9. A wristband comprising:

(a) an elastic strap, the strap being formed from a highly elasticized smooth textile having a first orifice and a second orifice;

(b) a watch housing with a display portion and a cylindrical insert portion, the display portion and the cylindrical insert portion are separated by a slot; the cylindrical insert portion and the orifice of the strap are sized and configured such that the cylindrical insert portion can be inserted into the strap orifice such that deformation of the highly elasticized smooth textile of the orifice results in a retaining force that cooperates with the slot to retain the watch housing to the strap; and (c) the first and second orifices of the strap cooperate with the cylindrical insert to define a closed path for retaining a wrist.

10. The wristband of claim 9, wherein the first orifice is alternatively positioned in the center of the strap to retain the watch housing, and the second orifice positioned at one strap terminal end, as means to connect opposite strap terminal end portion.

11. The wristband of claim 9, wherein the strap is planar or hollow tubular.

12. The wristband of claim 9 wherein strap is continuous and configured onto wristwatch, being void of visible projections or protrusions when worn.

* * * * *